US009786453B2

(12) United States Patent
Takano et al.

(10) Patent No.: US 9,786,453 B2
(45) Date of Patent: Oct. 10, 2017

(54) ROTATIONAL OPERATION TYPE SWITCH

(71) Applicants: FUJI ELECTRIC FA CONPONENTS & SYSTEMS CO., LTD., Tokyo (JP); CHICHIBU FUJI CO., LTD., Chichibu-gun, Saitama (JP)

(72) Inventors: Yoshihiro Takano, Kounosu (JP); Noriyoshi Machida, Kounosu (JP)

(73) Assignees: FUJI ELECTRIC FA COMPONENTS & SYSTEMS CO., LTD., Tokyo (JP); CHICHIBU FUJI CO., LTD., Chichibu-Gun, Saitama (JP)

( * ) Notice: Subject to any disclaimer, the term of this patent is extended or adjusted under 35 U.S.C. 154(b) by 14 days.

(21) Appl. No.: 14/936,115

(22) Filed: Nov. 9, 2015

(65) Prior Publication Data

US 2016/0079014 A1 Mar. 17, 2016

Related U.S. Application Data

(63) Continuation of application No. PCT/JP2014/061022, filed on Apr. 18, 2014.

(30) Foreign Application Priority Data

Jun. 21, 2013 (JP) ..... 2013-130782

(51) Int. Cl.
*H01H 19/00* (2006.01)
*H01H 21/00* (2006.01)
(Continued)

(52) U.S. Cl.
CPC ..... *H01H 19/585* (2013.01); *H01H 19/11* (2013.01); *H01H 19/14* (2013.01);
(Continued)

(58) Field of Classification Search
CPC ..... H01H 19/585; H01H 19/11; H01H 19/14; H01H 19/48; H01H 19/63; H01H 1/24
(Continued)

(56) References Cited

U.S. PATENT DOCUMENTS 6,396,006 B1 * 5/2002 Yokoji ..... G06F 3/0312 200/11 R
7,476,822 B2 1/2009 Miura et al.
(Continued)

FOREIGN PATENT DOCUMENTS

CN 101312104 11/2008
EP 0 989 385 A1 3/2000
(Continued)

OTHER PUBLICATIONS

China Patent Office, "Office Action for Chinese Patent Application No. 201480025858.1," Nov. 22, 2016.
(Continued)

*Primary Examiner* — Renee S Luebke
*Assistant Examiner* — Lheiren Mae A Caroc
(74) *Attorney, Agent, or Firm* — Manabu Kanesaka

(57) ABSTRACT

A rotational operation type switch includes a frame; a rotational operation button rotatably supported on the frame for rotational operation; a switching contact mechanism disposed below the operation button to face the operation button; and an operation mechanism disposed between the operation button and the switching contact mechanism, to switch the switching contact mechanism in conjunction with the rotational operation of the operation button. The switching contact mechanism includes a printed circuit board, a plurality of fixed contact electrodes disposed on the printed circuit board and spaced a predetermined distance away from each other, and a movable contact having a disc spring shape and disposed bridging between the plurality of fixed
(Continued)

contact electrodes. The movable contact deforms to contact and separate from the fixed contact electrodes and switches an electrical connection between the fixed contact electrodes.

5 Claims, 7 Drawing Sheets

(51) Int. Cl.

| | |
|---|---|
| ***H01H 19/58*** | (2006.01) |
| ***H01H 19/48*** | (2006.01) |
| ***H01H 19/63*** | (2006.01) |
| ***H01H 19/11*** | (2006.01) |
| ***H01H 19/14*** | (2006.01) |
| ***H01H 19/635*** | (2006.01) |
| *H01H 1/24* | (2006.01) |

(52) U.S. Cl.
CPC ..... *H01H 19/48* (2013.01); *H01H 19/63* (2013.01); *H01H 19/6355* (2013.01); *H01H 1/24* (2013.01)

(58) Field of Classification Search
USPC ..... 200/11 A, 336, 564
See application file for complete search history.

(56) References Cited

U.S. PATENT DOCUMENTS 8,294,049 B2 * 10/2012 Tsuduki ..... H01H 25/065 200/5 R
2011/0035902 A1 2/2011 Ikeda

FOREIGN PATENT DOCUMENTS

| | | | |
|---|---|---|---|
| EP | 2287871 | A2 | 2/2011 |
| FR | 2335933 | A1 | 7/1977 |
| FR | 2868592 | A1 | 10/2005 |
| JP | S34-832 | Y1 | 2/1959 |
| JP | H02-126316 | U | 10/1990 |
| JP | H07-220576 | A | 8/1995 |
| JP | 2000-097704 | A | 4/2000 |
| JP | 2003-151401 | A | 5/2003 |
| JP | 3936433 | B2 | 6/2007 |
| JP | 2008-047018 | A | 2/2008 |
| JP | 2012-243671 | A | 12/2012 |

OTHER PUBLICATIONS

Japan Patent Office, "Office Action for Japanese Patent Application No. 2015-522626," dated Nov. 15, 2016.
Europe Patent Office, "Search Report for European Patent Application No. 14814069.2," dated Dec. 20, 2016.
PCT, "International Search Report for International Application No. PCT/JP2014/061022".

* cited by examiner

ROTATIONAL OPERATION TYPE SWITCH

CROSS-REFERENCES TO RELATED APPLICATIONS

The present application is a Continuation application of PCT International Application No. PCT/JP2014/061022 filed Apr. 18, 2014, and claiming priority from Japanese Application No. 2013-130782 filed Jun. 21, 2013, the disclosure of which is incorporated herein.

TECHNICAL FIELD

The present invention relates to a rotational operation type switch wherein it is possible to switch a switching contact by rotationally operating an operation button, or it is possible to obtain signals different from one rotation position to another.

BACKGROUND ART

FIG. 8 shows one described in PTL 1 as a heretofore known example of this kind of rotational operation type switch.

A rotational operation type switch 50 shown in FIG. 8 includes a rotary knob 52 which is rotatably supported on the upper end of a frame 51. The frame 51 is fastened and fixed to the mounting panel of an control board (not shown) by a fastening nut 53. A rotating cylinder 55 linked to the rotary knob 52 is rotatably housed in the frame 51, and a cylindrical cam 56 is linked to the lower end of the rotating cylinder 55. A contact unit 57 is linked to the lower end of the frame 51. The leading end of a push bar 58 which operates and switches the contact of the contact unit 57 abuts against the cam surface of the cylindrical cam 56.

The rotary knob 52 is structured so as to be rotationally operable by inserting an operation key 60 therein in order to prevent an unintended rotational operation.

When operating the rotational operation type switch 50 structured in this way, the operation key 60 is inserted into the rotary knob 52, and the key 60 is rotationally operated in a right or left direction. The rotary knob 52 rotates with the rotation of the key 60, in conjunction with which the rotating cylinder 55 and the cylindrical cam 56 rotate. The push bar 58 is moved up and down in response to a change in position of the cam surface by the rotation of the cylindrical cam 56, and a contact mechanism 59 of the contact unit 57 is driven by the lower end of the push bar 58, thus switching (on and off) the contact.

This kind of heretofore known rotational operation type switch is formed such that the contact of the contact unit 57 can be switched by rotationally operating the rotary knob 52, but is structured by the contact unit and an operation mechanism which operates the contact unit being completely unitized and linked to each other in an axial direction. Therefore, there is the problem of an inevitable increase in the depth dimension of the switch from the operation surface of the switch. Also, when structuring the switch as a rotary selector switch, it is necessary to annex a number of contact mechanisms corresponding to the number of contact mechanisms to be selected, meaning that there is also the problem of an increase in the price of the switch as well as an increase in the overall size of the switch.

CITATION LIST

Patent Literature

PTL 1: Japanese Patent No. 3,936,433

SUMMARY OF INVENTION

Technical Problem

The invention, in order to solve the heretofore described problems of the heretofore known rotational operation type switch, has an object to provide a thin, miniature, and inexpensive rotational operation type switch, which is small in depth dimension from the operation surface of the switch, wherein it is possible to switch a switching contact mechanism by rotationally operating an operation button.

Solution to Problem

The invention, in order to achieve the heretofore described object, is provided with a rotational operation button supported on a frame so as to be rotationally operable; and one switching contact mechanism disposed below the operation button to face the operation button. In the switch, an operation mechanism, including a cam, which operates and switches the switching contact mechanism in conjunction with the rotational operation of the operation button, is provided between the operation button and the switching contact mechanism.

In the invention, the switching operation mechanism can be structured so as to operate and switch (on and off) the switching contact mechanism once for each rotation of the operation button through a predetermined rotation angle, and operate and switch (on and off) the switching contact mechanism for a plurality of times for one revolution of the operation button.

It is preferable that the switching contact mechanism includes a plurality of fixed contact electrodes, disposed on a printed circuit board so as to be spaced for a predetermined distance away from each other, and a disc spring shaped movable contact, disposed bridging between the plurality of fixed contact electrodes, which changes in shape by being pressed, and contacts to and separate from the fixed contact electrodes, thus switching the electrical connection between the fixed contact electrodes.

It is preferable that the operation mechanism includes an annular cam, of which a cam surface undulating in a circumferential direction is formed in the rear surface of the operation button so as to face the switching contact mechanism, and a push bar which, by being urged by a spring, brings one end face into abutment with the cam surface and operates the switching contact mechanism with the other end face.

Also, a plurality of engagement holes which engages a locking member is provided on the rear surface of the operation button, one for each predetermined rotation angle, and a locking member holding portion which holds the locking member via a spring is provided in one position on the frame which can engage the engagement holes of the operation button, thus enabling a range of rotation to be easily confirmed.

Furthermore, finger-hook holes are provided on the front surface of the operation button, one for each of rotation angles corresponding to those of the engagement holes, thus enabling the operation button to be easily rotationally operated.

Also, a switching contact mechanism switching detection circuit which counts the number of times to switch the switching contact mechanism is connected to the switching contact mechanism, thus distinguishing the rotational operation amounts of the operation button.

Advantageous Effects of Invention

The rotational operation type switch of the invention, as it is formed from a rotationally operable operation button supported on a frame, one switching contact mechanism, which is disposed facing the lower surface of the operation button, and an operation mechanism, including a rotary cam, which operates and switches the switching contact mechanism in conjunction with the rotational operation of the operation button, can be made thin and miniature.

DESCRIPTION OF EMBODIMENTS

Embodiments according to the invention will be described in detail with reference to the drawings.

Figure 1A:
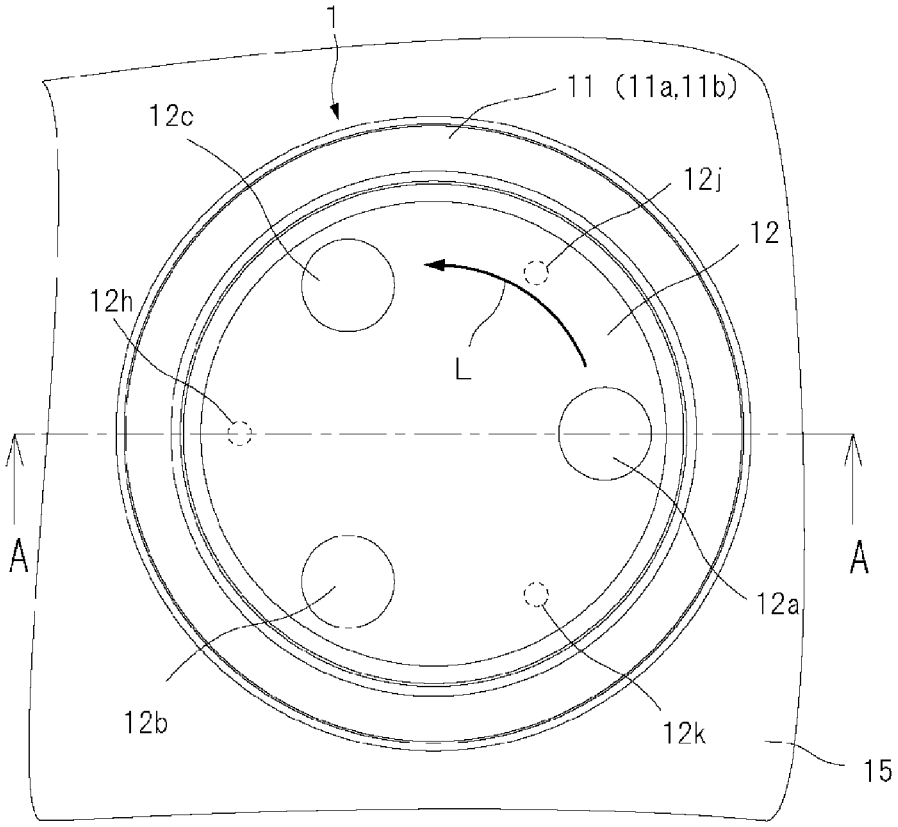
FIGS. 1(*a*), 1(*b*) show a structure of a rotational operation type switch of an embodiment of the invention, wherein FIG. 1(*a*) is a plan view, and FIG. 1(*b*) is a vertical sectional view along the line A-A in FIG. 1(*a*).
Figure 1B:
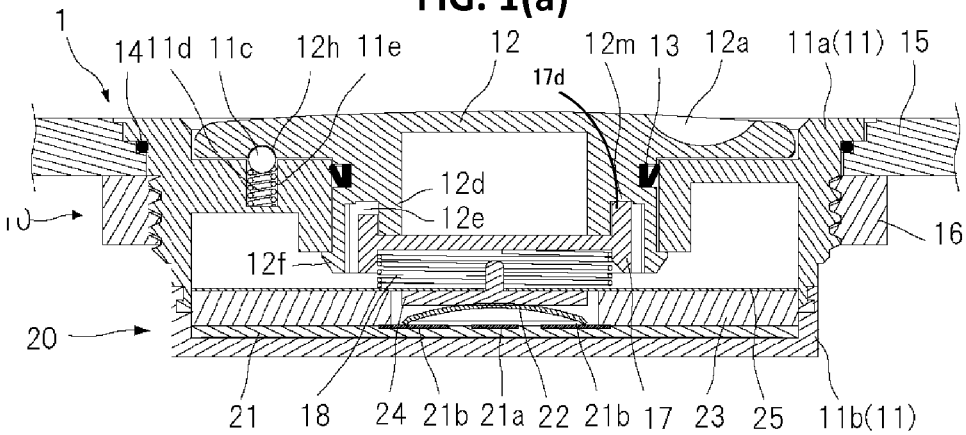

FIGS. 1(*a*) to 6(*c*) show an embodiment of a rotational operation type switch of the invention.

In FIGS. 1(*a*) and 2, reference 1 is a rotational operation type switch (hereafter sometimes simply called a switch). The switch 1 includes an integrated cup-shaped main body frame 11 into which halved upper frame 11*a* and lower frame 11*b* are linked together.

An operation section 10 is structured by inserting an operation button 12 into the upper frame 11*a* of the main body frame 11 via a packing 13 for preventing dust or water from intruding from the external. The operation button 12 inserted in the upper frame 11*a* is joined onto the upper frame 11*a* by engaging an engagement piece 12*f* of the operation button 12 with one portion of the upper frame 11*a*. By so doing, the operation button 12 is rotatably supported by the engagement piece 12*f* without disengaging from the upper frame 11*a*. Three finger-hook depressed portions 12*a*, 12*b*, and 12*c* are provided on the front surface of the operation button 12 at intervals of a predetermined rotation angle, herein, 120° in order to rotationally operate the operation button 12 with a finger hooked in the depressed portion.

Figure 3A:
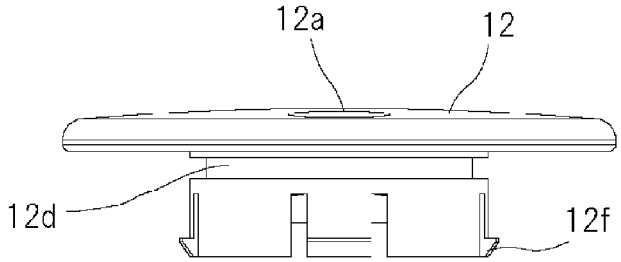
FIGS. 3(*a*), 3(*b*) show a structure of an operation button used in the rotational operation type switch of the invention, wherein FIG. 3(*a*) is an elevation view, and FIG. 3(*b*) is a rear view.
Figure 3B:
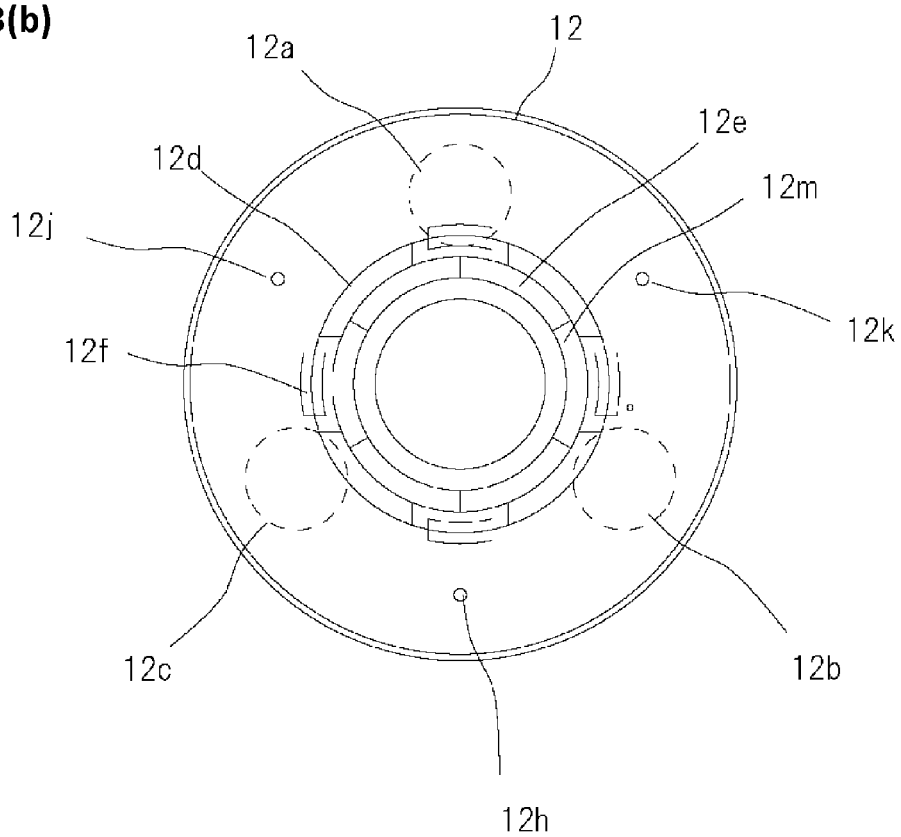
Figure 4:
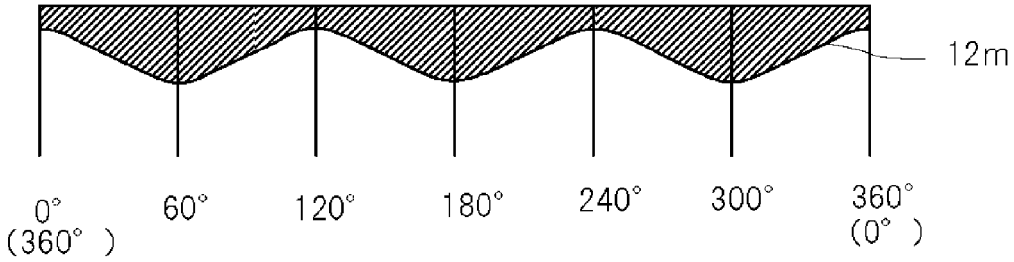
FIG. 4 is a developed vertical sectional view showing an embodiment of a cam formed in the rear surface of the operation button of the rotational operation type switch of the invention.

A cylindrical guide 12*d* is formed protruding on the rear surface side of the operation button 12, and an annular cam surface 12*m*, formed of an undulating surface continuing in a circumferential direction, is formed on the groove bottom of an annular groove 12*e* provided in the cylinder of the cylindrical guide 12*d* (refer to FIGS. 3(*a*) and 3(*b*)). The cam surface 12*m* is formed of an undulating surface having a waveform which forms trough portions in 0°, 120°, and 240° positions at intervals of 120°, and peak portions in 60°, 180°, and 300° positions out of phase with the trough portions by 60°, within the range of one revolution (360°), as shown in FIG. 4.

A push bar 17 formed in a cylindrical shape is loosely fitted in the annular groove 12*e* on which is formed the annular cam surface 12*m* of the cylindrical guide 12*d* on the rear surface side of the operation button 12. One protrusion 17*a* to abut the annular cam surface 12*m* of the cylindrical guide 12*d* is formed on the upper end face of the push bar 17. As the push bar 17 is urged upward from downward by a push bar urging spring 18 in an assembled condition, as shown in FIG. 1(*b*), the protrusion 17*a* on the upper end face is always abutting the annular cam surface 12*m* of the cylindrical guide 12*d*.

Three locking holes 12*h*, 12*j*, and 12*k* are further provided, at intervals of the same rotation angle (120°) as that of the finger-hook depressed portions 12*a*, 12*b*, and 12*c*, on the rear surface of the operation button 12 in order to reliably keep a predetermined operation position of the operation button. A holding hole 11*e* for holding a locking member formed from a locking ball 11*c* and a holding spring 11*d* which holds the locking ball 11*c* is provided in a position on the upper frame 11*a*, which is a rotation angle determination reference, so as to correspond to the locking hole 12*h* of the operation button 12. When the operation button 12 is rotationally operated, and one of the locking holes 12*h*, 12*j*, and 12*k* of the operation button 12 comes to a position on the upper frame 11 facing the holding hole 11*e*, the locking ball 11*c* is pushed into one of the locking holes 12*h* to 12*k* by the holding spring 11*d*, meaning that the operation button 12 is locked in the position.

Meanwhile, a printed circuit board 21, which includes a conductor pattern forming a plurality of fixed contact electrodes 21*a* and 21*b*, a circular, disc spring shaped movable contact piece 22, a distance keeping insulating liner 23, a push plate 24, and a protective flexible insulating sheet 25 are inserted in order into the lower frame 11*b* of the main body frame 11, and disposed, stacked one on another, on the bottom wall of the lower frame 11*b*, thereby forming a switching contact mechanism 20, as shown in FIG. 1(*b*). The lower frame 11*b* housing the switching contact mechanism 20 in this way is fitted on the lower end side of the upper frame 11*a* in which the operation section is formed, and the lower frame 11*b* and the upper frame 11*a* are linked together by appropriate joining means such as a male/female engagement mechanism.

Figure 5A:
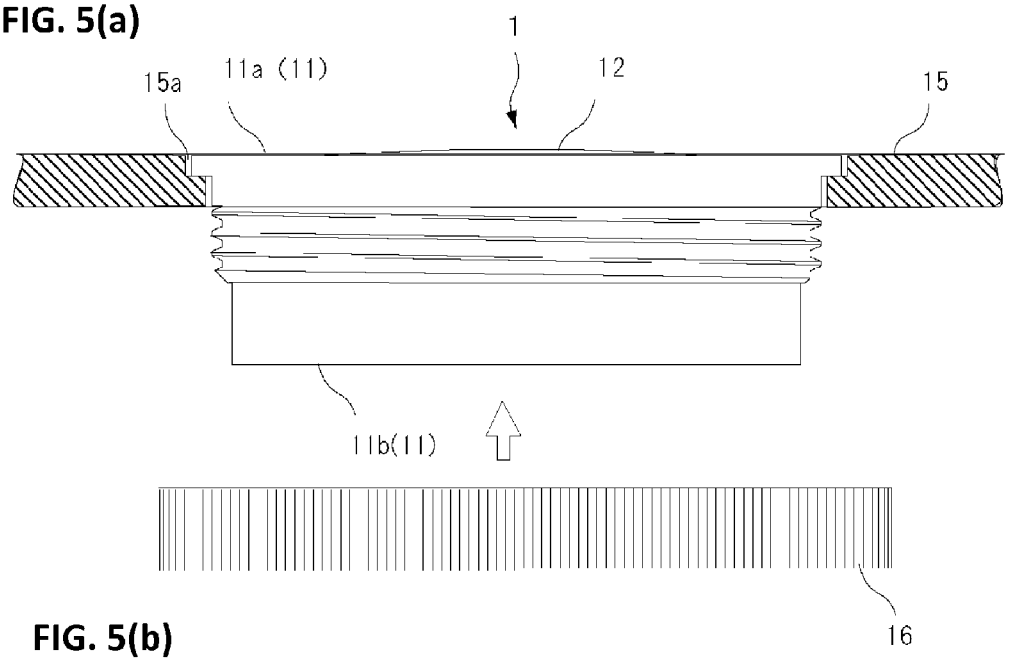
FIGS. 5(*a*), 5(*b*) show a condition in which the rotational operation type switch of the invention is mounted in a mounting panel, wherein FIG. 5(*a*) is a diagram showing a condition in which the rotational operation type switch is inserted in the mounting panel, and FIG. 5(*b*) is a diagram showing a condition in which the rotational operation type switch is fixed in the mounting panel.
Figure 5B:
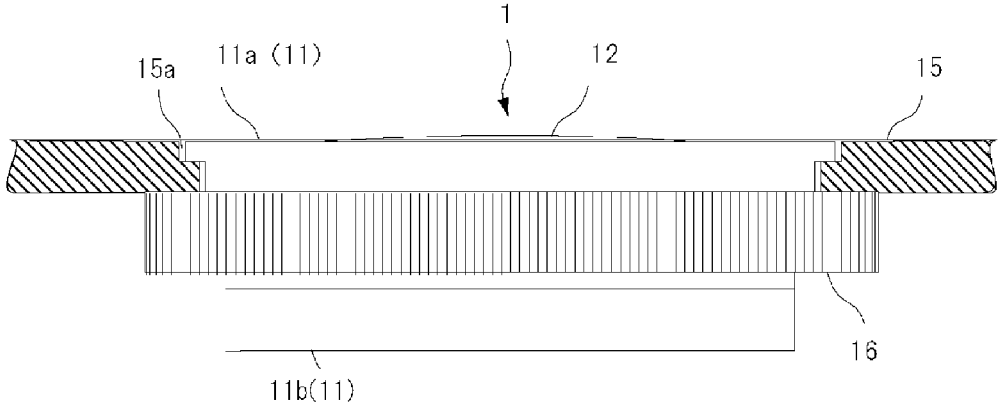

When mounting the switch 1, assembled in this way, in amounting panel 15 of a control board or the like, as shown in FIG. 5(*a*), the switch 1 is inserted into a mounting through hole 15*a*, which is provided in the panel 15, from the front side of the panel 15, and is fixed in the panel 15 by screwing a fastening nut 16 onto the switch 1 from the rear surface side of the panel 15 and fastening the fastening nut 16 to the panel 15. By so doing, the switch 1 is mounted and fixed in the mounting panel 15, as shown in FIG. 5(*b*).

Figure 2:
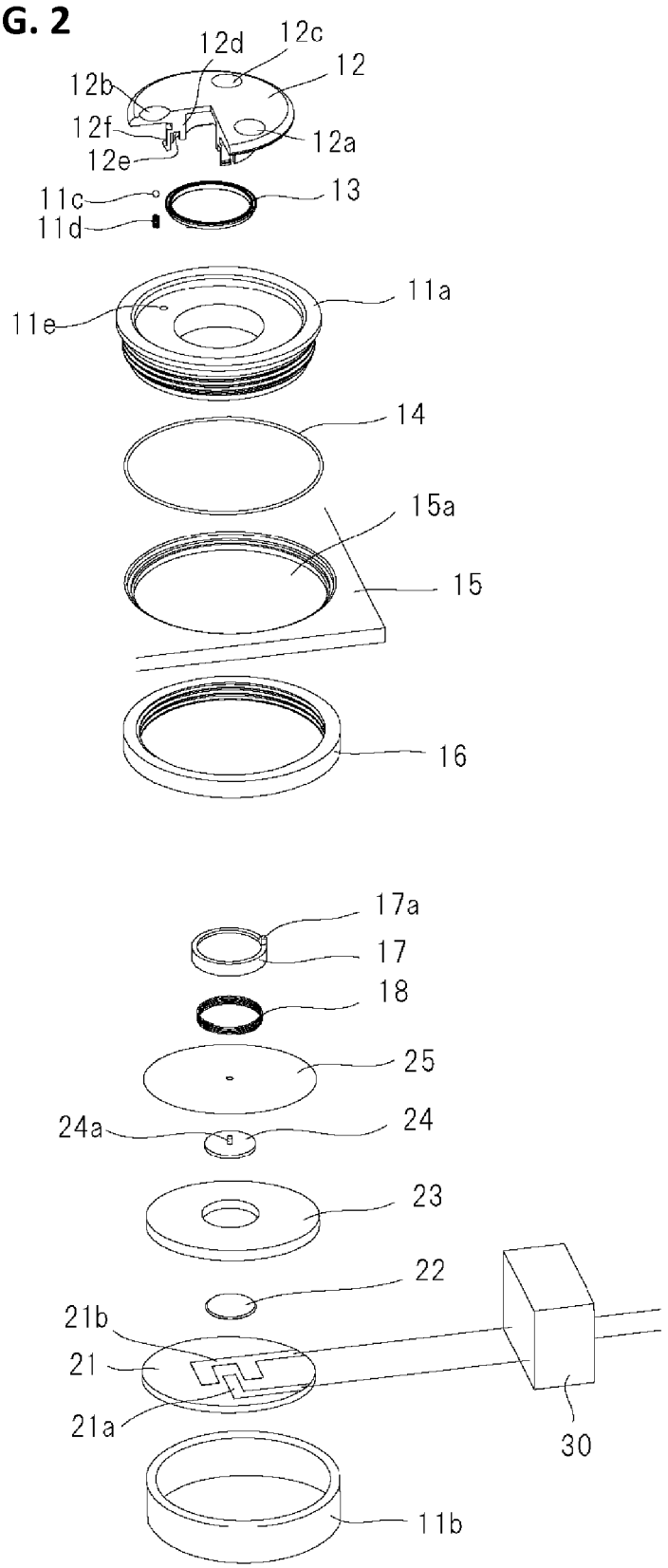
FIG. 2 is an exploded perspective view showing a structure of the rotational operation type switch of the embodiment of the invention.

With the switch 1 of the invention, switching detection means 30 structured from an electronic circuit which detects an electrical connection between the fixed contact electrodes 21*a* and 21*b* provided on the printed circuit board 21 is prepared, as shown in FIG. 2, in order to detect a switching operation of the switching contact mechanism 20, and by connecting the switching detection means 30 to the fixed contact electrodes 21*a* and 21*b*, it is possible to detect a rotation position of the operation button 12 from an output of the switching detection means 30, and thus possible to apply the switch 1 to a selector switch or the like.

Next, a description will be given, referring to FIGS. 6(*a*)-6(*c*), of an operation of the thus structured switch 1 of the invention.

Herein, a position of the operation button 12 when the finger-hook depressed portion 12*a* is in the three o'clock position, as shown in FIG. 1(*a*), is set to a reference position (a rotation angle 0° position).

Figure 6A:
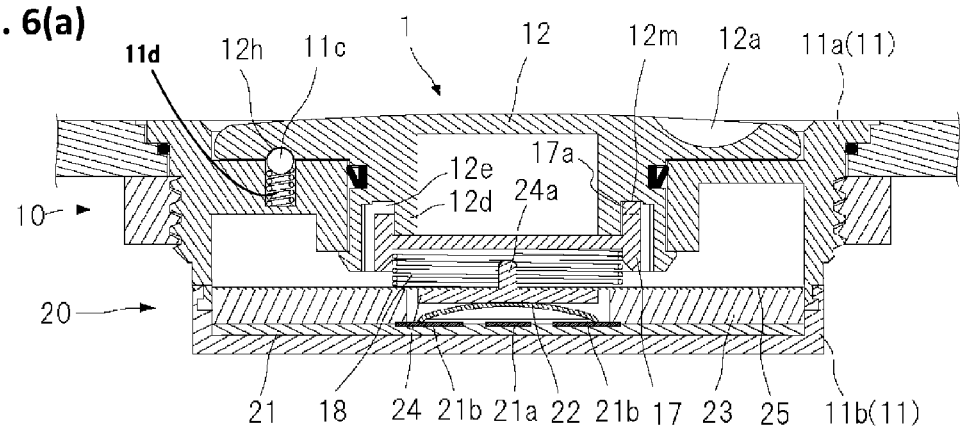
FIGS. 6(*a*)-6(*c*) are illustrations of an operation of the rotational operation type switch of the invention.
Figure 6B:
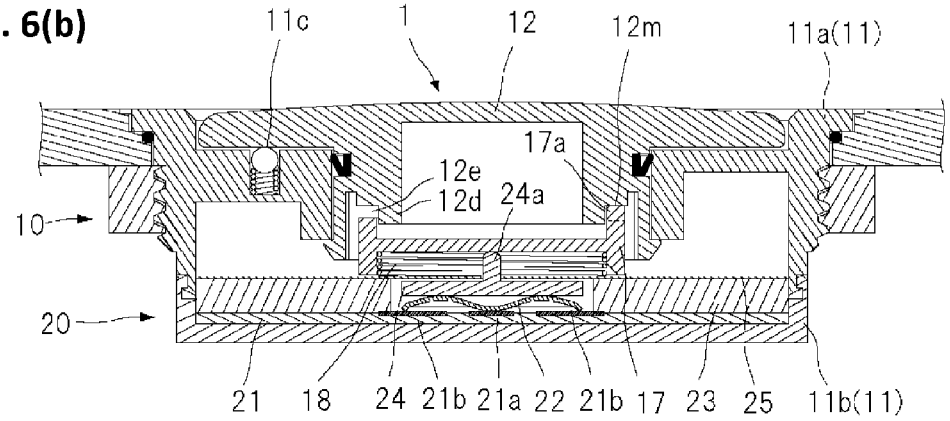
Figure 6C:
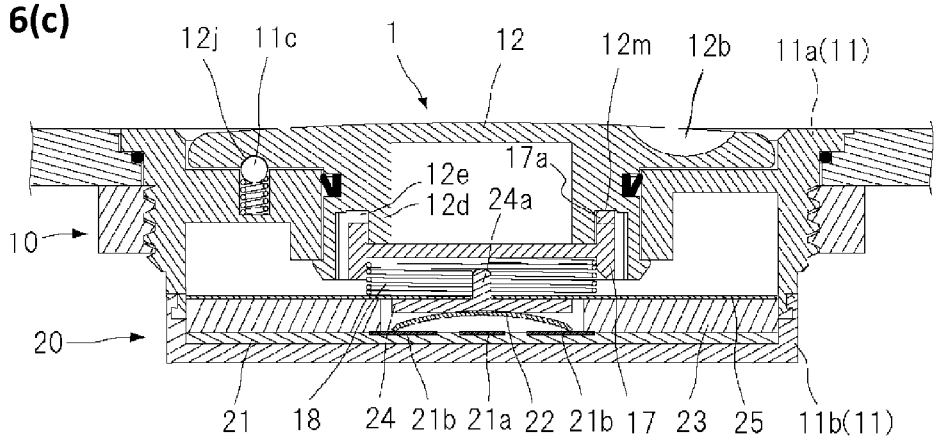

FIG. 6(*a*) shows a condition of the switch 1 when the operation button 12 is placed in the reference position. In the condition, as the push bar 17 of the switch 1 is pushed up by the spring 18 until the protrusion 17*a* of the push bar 17 contacts the trough portion in the 0° position of the cam surface 12*m* shown in FIG. 4, the push bar 17 is separated from the push plate 24. Therefore, the disc spring shaped movable contact piece 22 is curved upward, and the outer peripheral end of the movable contact piece 22 contacts only one fixed contact electrode 21*b*, meaning that the electrical connection between the fixed contact electrodes 21*a* and 21*b* becomes a disconnected (off) state.

In this condition, as the locking ball 11*c* is pushed up by the locking spring 11*d*, the ball 11*c* fits into the locking hole 12*h* on the rear surface of the operation button 12, and locks and fixes the operation button 12, thus preventing the operation button 12 from being casually rotated.

Next, FIG. 6(*b*) shows a condition when the operation button 12 is rotated 60° from the original position in the process of being rotationally operated one pitch (120°) in the arrow L (counterclockwise) direction in FIG. 1(*a*).

At this time, as the protrusion 17*a* of the push bar 17 comes to the position (the 60° position in FIG. 4) which is the peak portion of the cam surface of the cylindrical guide 12*d*, the push bar 17 is pushed down by the peak portion of the cam surface. As the push plate 24 is pushed down as a result of this, the disc spring shaped movable contact piece 22 is pressed and changed into a form in which the central portion of the movable contact piece 22 is depressed. By so doing, the central portion of the movable contact piece 22 contacts the fixed contact electrode 21*a* on the printed circuit board 21, meaning that the fixed contact electrodes 21*a* and 21*b* are electrically connected by the movable contact piece 22, and the electrical connection between the two fixed contact electrodes becomes a connected (on) state.

In an initial position of rotational operation of the operation button 12, as the operation button 12 is in a condition in which the locking ball 11*c* is in engagement with the locking hole 12*h* of the operation button 12, it is necessary to rotationally operate the operation button 12 using a little greater force with a fingertip hooked in the finger-hook depressed portion 12*a*. As the locking ball 11*c* is pushed in against the urging force of the spring 11*d* by the inclined surface of the locking hole 12*h* as a result of the rotational operation, and disengages the locking hole 12*h*, it is thereafter possible to continue the rotational operation using a small force.

When the operation button 12 is rotated 120°, and the next finger-hook depressed portion 12*b* rotates to the three o'clock position, the locking ball 11*c* engages the next locking hole 12*j* of the operation button 12, and it is possible to reliably lock the operation button 12 in one pitch's worth of rotation position (refer to FIG. 6(*c*)).

The switch 1 is formed such that in this position, the annular cam surface 12*m* in the cylindrical guide 12*d* rotates, and the cam surface which is the trough portion in the 120° position in FIG. 4 contacts the protrusion 17*a* of the push bar 17. Therefore, as shown in FIG. 6(*c*), the push bar 17 is pushed up by the spring 18 and separated from the push plate 24, as a result of which there is no more pressing force applied to the disc spring shaped movable contact piece 22, meaning that the movable contact piece 22 returns to the original shape in which the movable contact piece 22 is curved upward, and the electrical connection between the two fixed contact electrodes 21*a* and 21*b* becomes a disconnected (off) state.

In this way, when the operation button 12 is rotationally operated one fixed pitch (120°), the switching contact mechanism 20 performs the operation of turning from OFF to ON only once and back to OFF again. When the operation button 12 is rotationally operated two pitches, the switching contact mechanism 20 exhibits on-state twice.

Further, when the operation button 12 is rotationally operated three pitches (operated one revolution), the switching contact mechanism 20 exhibits on-state three times. Therefore, the number of times the switching contact mechanism 20 becomes on-state for every one rotational operation of the operation button 12 is counted by the switching detection means 30, shown in FIG. 2, which monitors the switching condition of the switching contact mechanism 20, thereby enabling knowing of the rotation pitch and thus rotation position of the operation button 12, and a structure is adopted such as to output signals different from pitch to pitch, thereby enabling the switch 1 to be provided with a function equivalent to a selector switch.

Figure 7:
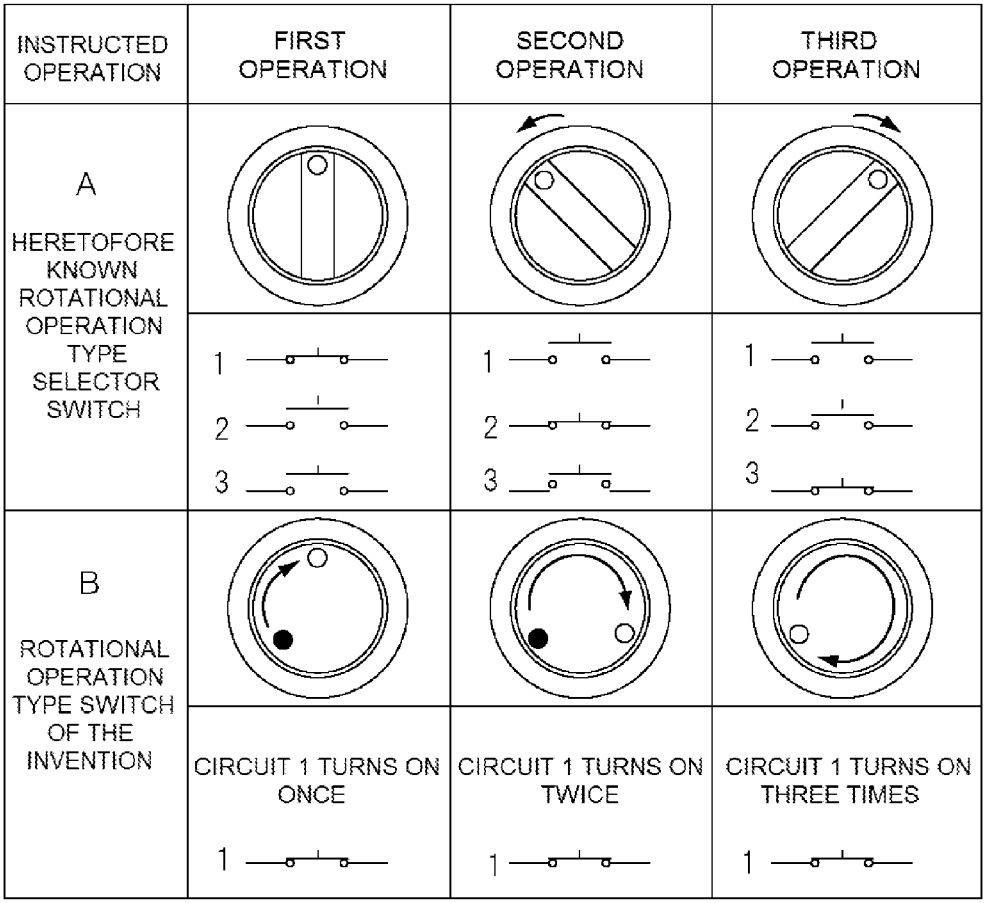
FIG. 7 is a function comparison diagram of a heretofore known rotational operation type switch and the rotational operation type switch of the invention.
Figure 8:
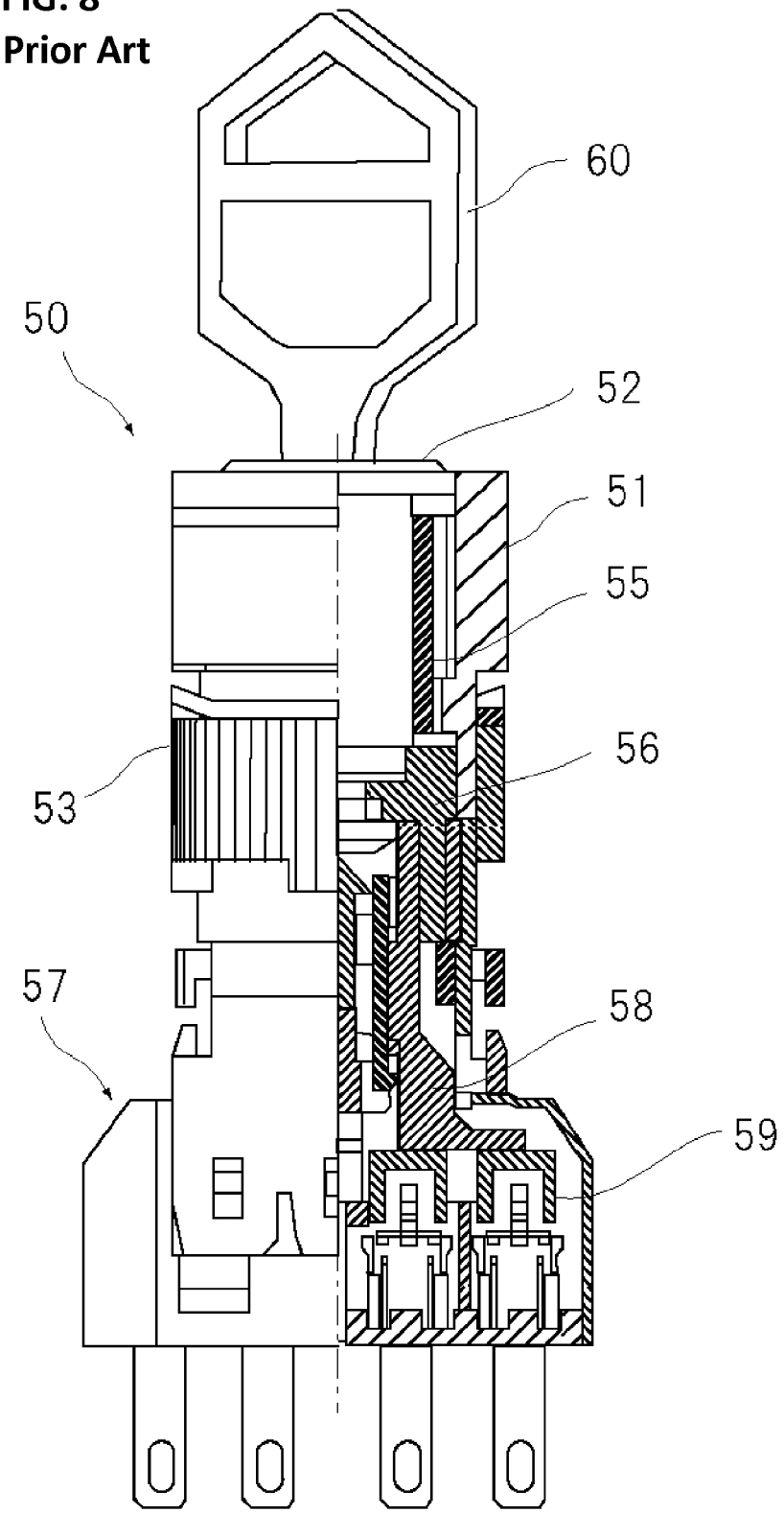
FIG. 8 Prior Art
FIG. 8 is an elevation view including a partial section showing a structure of the heretofore known rotational operation type switch.

A comparison of an operation of this kind of rotational operation type switch of the invention with an operation of a heretofore known rotational operation type selector switch is shown in FIG. 7 as a function comparison diagram.

Each of the two switches can select three operations. Therefore, a heretofore known switch A includes a rotary knob, which enables selection of three positions by being rotationally operated, and three contact circuits 1, 2, and 3.

The heretofore known selector switch is formed such that when a first operation position is selected with the rotary knob, the contact circuit 1 turns on, and the other two contact circuits turn off, as shown in the A column. When a second operation position is selected by rotating the rotary knob, the contact circuit 2 turns on, and the other two contact circuits turn off. Furthermore, when a third operation position is selected by rotating the rotary knob, the contact circuit 3 turns on, and the other two contact circuits turn off.

In contrast, the switch of the invention is similar to the heretofore known selector switch in that three positions are selected by rotating the operation button through one predetermined rotation angle for each position selection, but the switch of the invention includes only one contact circuit.

The switch of the invention is formed such that when a first operation of rotating the operation button from a first operation position to a second operation position is carried out, the contact circuit turns on once, as shown in the B column. When a second operation of rotating the operation button from the first operation position to a third operation position is carried out, the contact circuit turns on twice. Furthermore, when a third operation of rotating one revolution from the first operation position to the first operation position is carried out, the contact circuit turns on three times, and it is thereby possible to obtain three different output signals in the same way as in the heretofore known selector switch which selects three positions.

In the above, an example wherein the operation button is rotationally operated at pitches of 120° has been shown, but in the invention, the rotation pitch angle of the operation button, not being limited to this, can be optionally set.

REFERENCE SIGNS LIST

1: Rotational operation type switch
11: Main body frame
11*a*: Upper frame
11*b*: Lower frame
11*c*: Locking ball (locking member)
12: Rotational operation button
12*a*, 12*b*, 12*c*: Finger-hook depressed portion
12*d*: Cylindrical guide
12*e*: Annular groove
12*m*: Annular cam surface
12*h*, 12*j*, 12*k*: Locking hole
17: Push bar
18: Push bar biasing spring
20: Switching contact mechanism
21: Printed circuit board
21*a*, 21*b*: Fixed contact electrode
22: Movable contact piece
24: Push plate
30: Switching contact mechanism switching detection means

What is claimed is:

1. A rotational operation type switch, comprising:

a frame;

a rotational operation button rotatably supported on the frame for rotational operation;

a switching contact mechanism disposed below the operation button to face the operation button; and an operation mechanism including a cam, and disposed between the operation button and the switching contact mechanism, to switch the switching contact mechanism in conjunction with the rotational operation of the operation button, wherein the switching contact mechanism includes a printed circuit board, a plurality of fixed contact electrodes disposed on the printed circuit board and spaced at a predetermined distance away from each other, and a movable contact having a disc spring shape and disposed bridging between the plurality of fixed contact electrodes, the movable contact deforms to contact with and separate from the plurality of fixed contact electrodes and switches an electrical connection between the plurality of fixed contact electrodes, and the operation mechanism includes an annular cam formed with a cam surface on a rear surface of the operation button to face the switching contact mechanism, the cam surface undulating in a circumferential direction of the operation button, and a push bar urged by a spring so that one end face thereof abuts against the cam surface and another end face thereof operates the switching contact mechanism.

2. The rotational operation type switch according to claim 1, wherein the operation mechanism is structured to switch the switching contact mechanism one time for each rotation of the operation button for a predetermined rotation angle, and to switch the switching contact mechanism for a plurality of times for one revolution of the operation button.

3. The rotational operation type switch according to claim 1, further comprising a switching contact mechanism switching detection circuit connected to the switching contact mechanism, for counting number of switching of the switching contact mechanism and distinguishing rotational operation amounts of the operation button.

4. A rotational operation type switch, comprising:

a frame, a rotational operation button rotatably supported on the frame for rotational operation, a switching contact mechanism disposed below the operation button to face the operation button, an operation mechanism including a cam, and disposed between the operation button and the switching contact mechanism, to switch the switching contact mechanism in conjunction with the rotational operation of the operation button, a plurality of locking holes each being formed on a rear surface of the operation button at a predetermined rotation angle, a locking member to engage with the plurality of locking holes, and a locking member holding portion holding the locking member through a spring provided at one position of the frame to engage the plurality of locking holes of the operation button, wherein the switching contact mechanism includes a printed circuit board, a plurality of fixed contact electrodes disposed on the printed circuit board and spaced at a predetermined distance away from each other, and a movable contact having a disc spring shape and disposed bridging between the plurality of fixed contact electrodes, and the movable contact deforms to contact with and separate from the plurality of fixed contact electrodes and switches an electrical connection between the plurality of fixed contact electrodes.

5. The rotational operation type switch according to claim 4, wherein a front surface of the operation button is provided with finger-hook holes, and each of the finger-hook holes is formed at a rotation angle corresponding to that of each of the plurality of locking holes.

* * * * *